US006546906B2

(12) United States Patent
Ozeki

(10) Patent No.: US 6,546,906 B2
(45) Date of Patent: Apr. 15, 2003

(54) INSTALLATION STRUCTURE OF OIL CONTROL VALVE

(75) Inventor: Hisashi Ozeki, Shizuoka-ken (JP)

(73) Assignee: Suzuki Motor Corporation, Hamamatsu (JP)

( * ) Notice: Subject to any disclaimer, the term of this patent is extended or adjusted under 35 U.S.C. 154(b) by 61 days.

(21) Appl. No.: 09/796,021

(22) Filed: Feb. 28, 2001

(65) Prior Publication Data

US 2001/0017120 A1 Aug. 30, 2001

(30) Foreign Application Priority Data

Feb. 29, 2000 (JP) ..... 2000-053910

(51) Int. Cl.[7] ..... F01M 1/16
(52) U.S. Cl. ..... 123/196 R; 123/196 AB
(58) Field of Search ..... 123/196 R, 41.49, 123/41.63, 41.65, 196 AB

(56) References Cited

U.S. PATENT DOCUMENTS 3,942,503 A * 3/1976 Hanaoka et al. ..... 123/196 AB
5,216,983 A * 6/1993 Nilson ..... 123/41.12
5,690,082 A * 11/1997 Tanioka et al. ..... 123/41.31
5,718,196 A * 2/1998 Uchiyama et al. ..... 123/41.33
6,076,488 A * 6/2000 Yamagishi ..... 123/41.12
6,343,572 B1 * 2/2002 Pfaff et al. ..... 123/41.01

FOREIGN PATENT DOCUMENTS

JP 11-324629 11/1999

* cited by examiner

*Primary Examiner*—Gene Mancene
*Assistant Examiner*—Jason Benton
(74) *Attorney, Agent, or Firm*—Flynn, Thiel, Boutell & Tanis, P.C.

(57) ABSTRACT

An installation structure for an oil control valve, wherein a timing chain transmitting rotation of a crankshaft of an engine to camshafts is arranged, and a chain cover is installed on the engine so as to cover the timing chain. A cooling fan rotated by the crankshaft is located forward of a front part of the chain cover 14. An oil control valve which supplies oil delivered from an oil pump to an oil pressure actuator of an oil pressure control unit is mounted to a front part of the chain cover within the rotational trace of the cooling fan.

6 Claims, 7 Drawing Sheets

INSTALLATION STRUCTURE OF OIL CONTROL VALVE

FIELD OF THE INVENTION

This invention relates to an installation structure of an oil control valve, and particularly to an installation structure of an oil control valve which can reduce change of valve characteristics at intervals from the cool state until an engine is in an operating state, which can improve the controlling of a cool oil pressure actuator, and which can improve precision control of an oil pressure control unit.

BACKGROUND OF THE INVENTION

An engine disposed in a vehicle supplies oil delivered from an oil pump to a dynamic valve, a supplemental apparatus and an oil pressure control unit, and effects lubrication, operation and controlling. For example, as an oil pressure control unit of an engine, there is a variable valve timing apparatus for varying valve timing of intake valve and exhaust valve.

A variable valve timing apparatus consists of an oil pressure actuator arranged at one end of a camshaft, and an oil control valve for supplying oil delivered from an oil pump to the oil pressure actuator. The variable valve timing apparatus supplies oil delivered from the oil pump to the oil pressure actuator by an oil control valve, and varies valve timing of intake and exhaust valves by working the oil pressure actuator.

One example of such arrangement is disclosed in published Japanese Patent Application Laid-Open No. 11-324629. As the installation structure of the oil control valve, in the oil control valve of the 4-cycle engine having a variable valve timing apparatus, the oil control valve is located in the bottom side of a camshaft axis line and in the outside of a timing chain line, and is installed to an engine chain cover.

Incidentally, in an oil control valve of an oil pressure control unit, there is a type supplying oil to an oil pressure actuator by a main valve part that is actuated by a solenoid part.

However, in the oil control valve, the valve characteristics undesirably vary in intervals from the cool state until the engine is in an operating state because the solenoid part generates heat when electrically energized. In addition, the oil control valve causes a reduction of control of the oil pressure actuator supplied oil, as a result, there is reduced controlling accuracy of the oil pressure control unit.

To obviate or minimize the above inconvenience, the present invention provides an installation structure of an oil control valve, wherein a timing chain transmits rotation of a crankshaft of an engine to camshafts, a chain cover is installed to the engine so as to cover the timing chain, a cooling fan rotated by the crankshaft is located forward of the front part of the chain cover, an oil pump driven by the crankshaft is arranged, an oil control valve which supplies oil delivered from the oil pump to an oil pressure actuator for an oil pressure control unit is located, and the oil control valve is installed to a front part of the chain cover in the rotational trace of the cooling fan. As a result, the installation structure of the oil control valve can reduce changes of valve characteristics in intervals from the cool state until the engine is in an operating state, and the controlling of cold oil pressure actuator is improved, and the controlling accuracy of an oil pressure control unit is improved.

In the installation structure of an oil control valve of this invention, because the oil controlling system is installed on a front surface of a chain cover so as to be located in the rotation air flow trace of the cooling fan rotated by the crankshaft, the oil control valve can be positively cooled by cool wind from the cooling fan, thereby reducing change of valve characteristics at intervals from the cool state until the engine is in an operating state.

DETAILED DESCRIPTION

The present invention will now be described in specific detail with reference to FIGS. 1 to 8 which illustrate a first embodiment of this invention.

Figure 1:
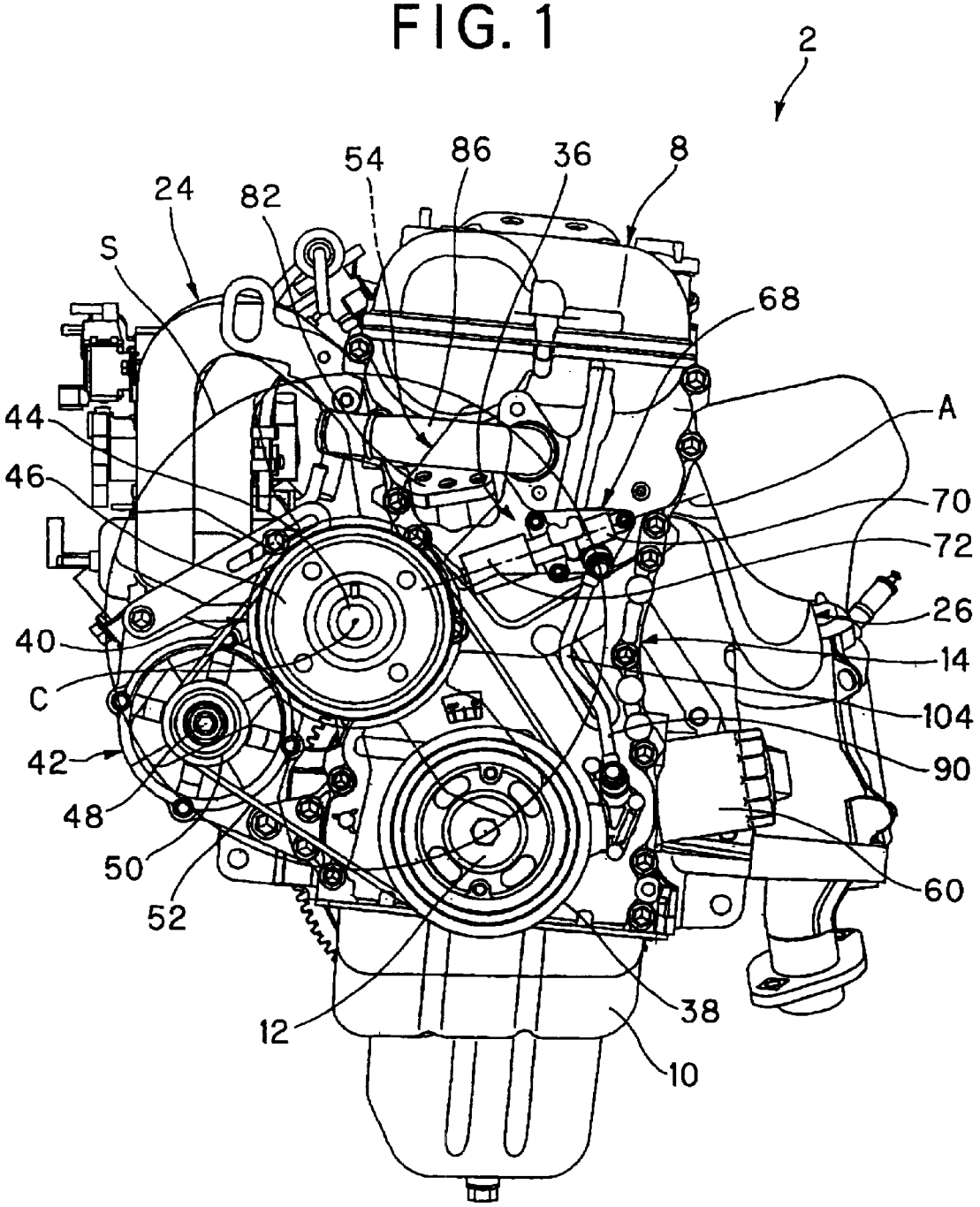
FIG. 1 is a front view of an engine showing a first embodiment of an installation structure of an oil control valve according to this invention.
Figure 2:
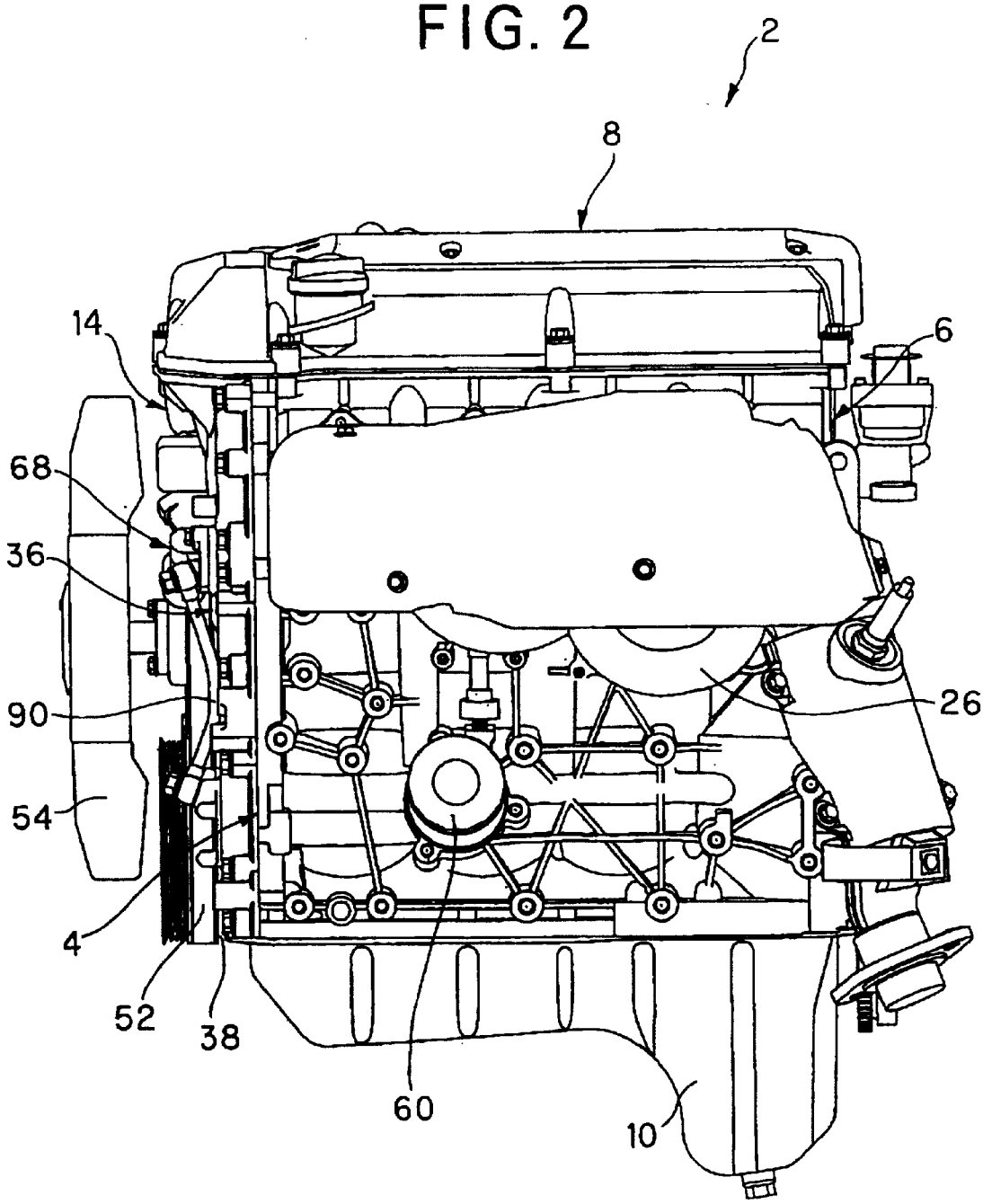
FIG. 2 is a side view of the engine of FIG. 1.
Figure 3:
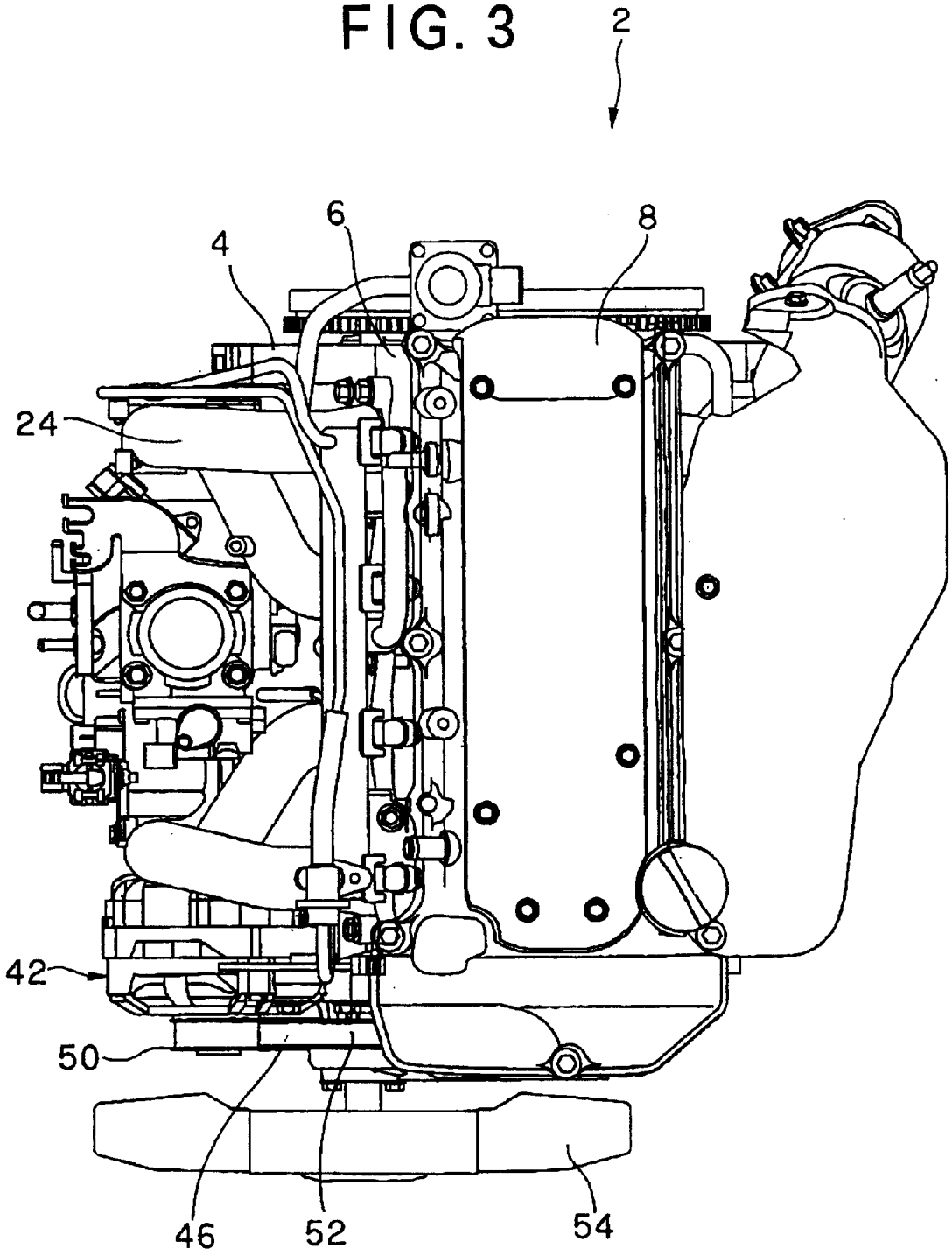
FIG. 3 is a plan view of an engine of FIG. 1.

In FIGS. 1 to 3, reference numeral 2 denotes an internal combustion engine disposed in a vehicle (not shown); 4 a cylinder block; 6 a cylinder head; 8 a head cover; 10 an oil pan; 12 a rotatable crankshaft; and 14 a chain cover. This engine is positioned lengthwise in an engine compartment of a vehicle (not illustrated).

Figure 4:
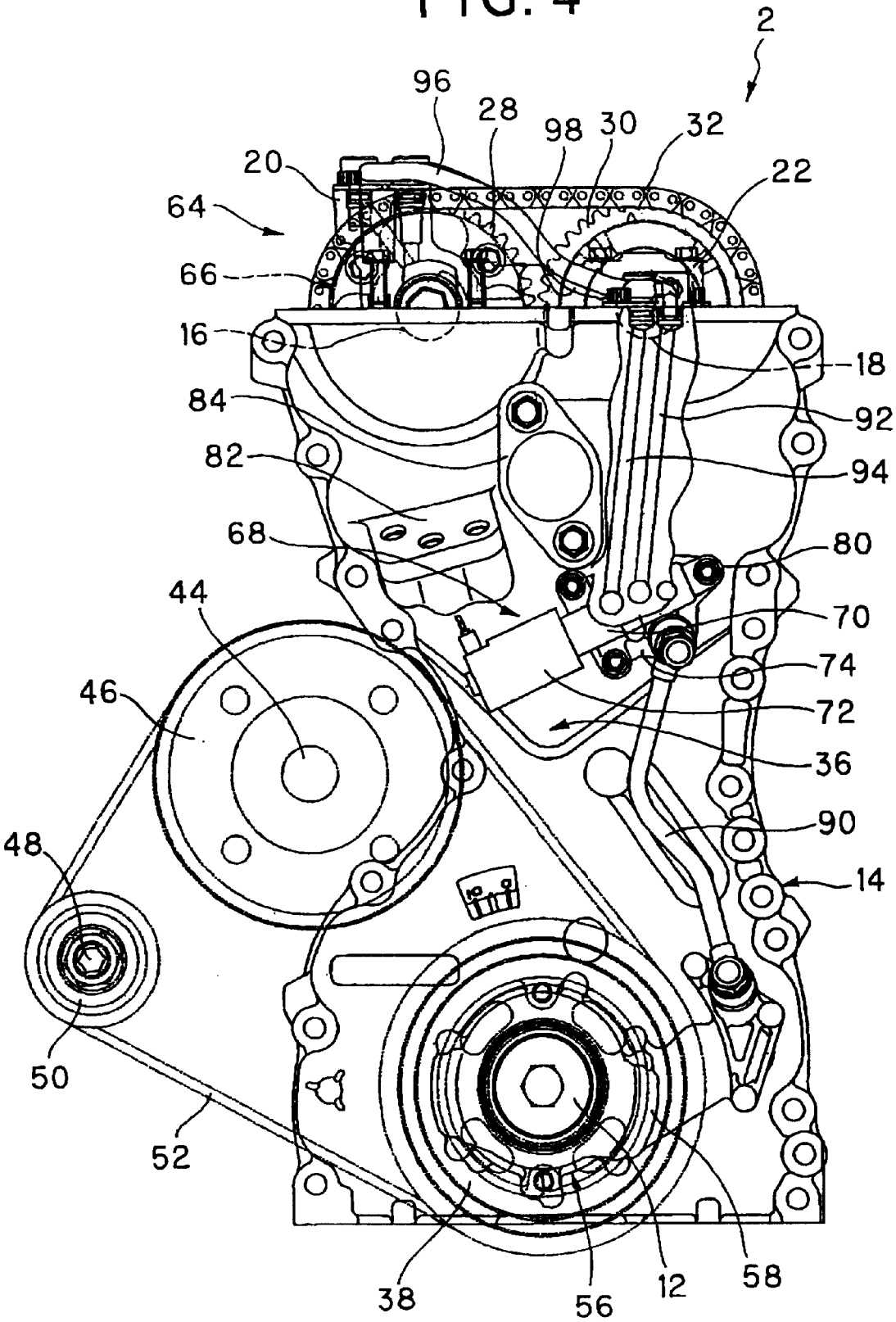
FIG. 4 is a front view of the engine with the cooling fan removed for clarity of illustration.
Figure 5:
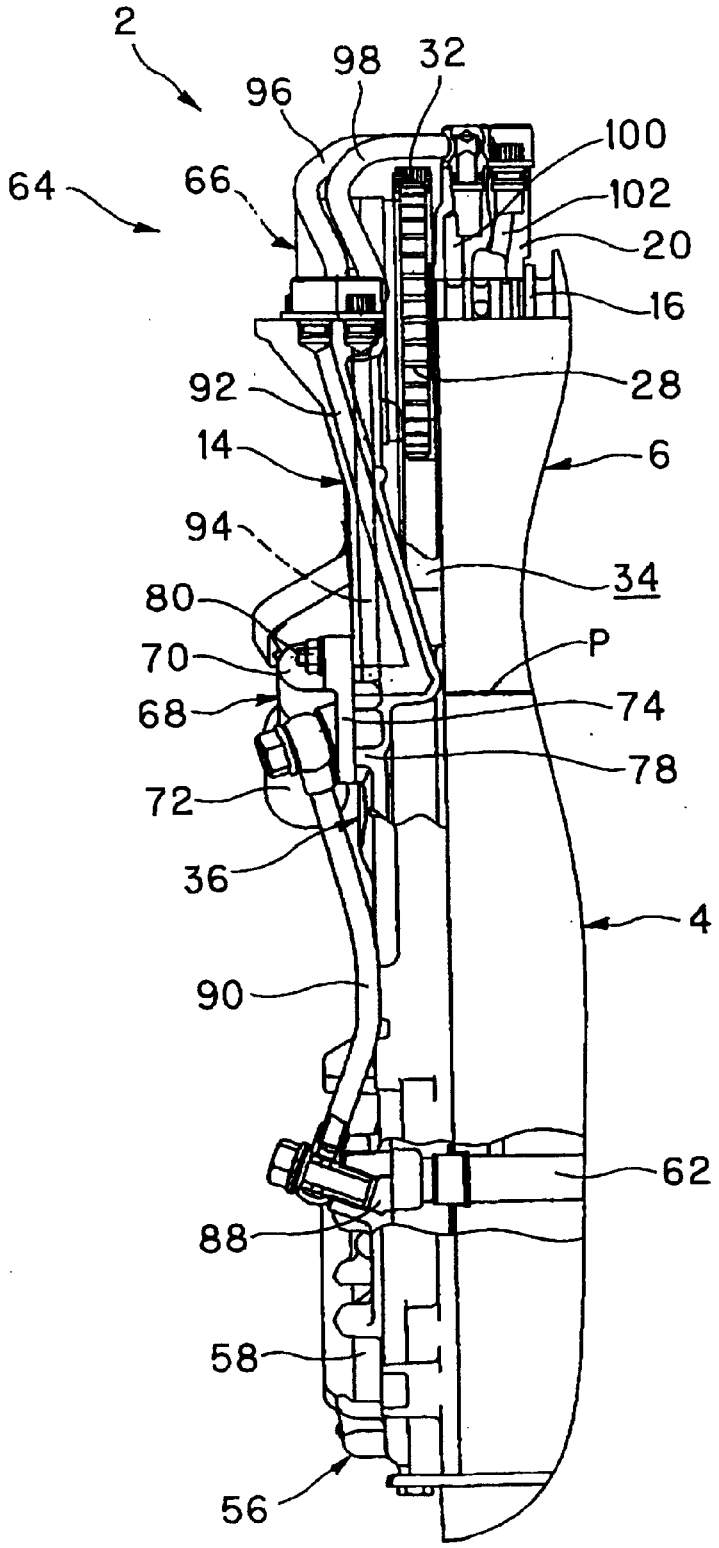
FIG. 5 is a side view with parts broken partly away, and showing a chain cover part of an engine.

The engine 2, as shown in FIGS. 4 and 5, is established from the crankshaft 12 supported in a lower part of the cylinder block 4, and the oil pan 10 installed below and encloses the crankshaft 12. In addition, the engine 2 is established from the cylinder head 6 mounted to an upper part of the cylinder block 4. An intake camshaft 16 and an exhaust camshaft 18, for opening and closing intake and exhaust valves (not shown), are supported on an upper part of the cylinder head 6 by caps 20 and 22. An intake manifold 24 and an exhaust manifold 26 (FIG. 1) are mounted to an upper part of the cylinder head 6, and the head cover 8 is mounted to cylinder head 6 so as to cover the camshafts 16 and 18.

A timing sprocket (not shown) is mounted on the crankshaft 12 at one end thereof. An intake cam sprocket 28 and an exhaust cam sprocket 30 are mounted to one end of the respective camshafts 16 and 18. A timing chain 32 extends between and is fitted to the timing sprocket and the intake cam sprocket 28 and exhaust cam sprocket 30. The timing chain 32 transmits rotation of crankshaft 12 to the camshafts 16 and 18.

In the engine 2, the chain cover 14 is installed to one end of cylinder block 4 and cylinder head 6 in the longitudinal direction of the engine so as to cover the timing chain 32, and a chain room or compartment 34 (FIG. 5) is formed behind the cover.

In the engine 2, a crank pulley 38 is mounted on crankshaft 12 so as to be located just before (in front of) a front wall part 36 of chain cover 14. In addition, the engine 2 has more than one supplemental apparatus that are driven by crankshaft 12. In the first embodiment, as shown in FIGS. 1 to 3, a water pump 40 and an alternator 42 are installed to one side of cylinder block 4 in a widthwise direction of the engine and are driven from shaft 12.

As shown in FIG. 4, the chain cover 14 is bent to a direction of cylinder axis at its about intermediate part, the water pump 40 is arranged in this curve part. In the water pump 40, water pump pulley 46 is installed to water pump axle 44 so as to be located just before a front part 36 of chain cover 14. The alternator 42 is arranged downward and diagonally leftwardly from the water pump 40 and upward and diagonally leftwardly from the crank pulley 38, or almost under the intake manifold 24. In the alternator 42, the crank pulley 50 is mounted to alternator axle 48 so as to be located just in front of a front part 36 of chain cover 14. A belt 52 for driving a supplement apparatus drive is fitted around the crank pulley 38, water pump pulley 46 and alternator pulley 50.

A cooling fan 54 is mounted on axle 44 in front of the water pump pulley 46. The cooling fan 54 is located forward of the front part 36 of chain cover 14, and is rotated by the crankshaft 12 through the belt 52.

The engine 2, as shown in FIGS. 4 and 5, has an oil pump 56 driven by crankshaft 12. In the oil pump 56, an inner rotor and an outside rotor (not shown) is positioned within pump housing 58 located in chain cover 14. This inner rotor and outside rotor is rotated by crankshaft 12, and the oil pump 56 delivers oil in oil pan 10 to the engine.

The oil delivered from oil pump 56, after being filtered by oil filter 60, is supplied to a main gallery or passageway 62 which extends along the cylinder block 4 parallel with an axis direction of crankshaft 12. The oil of main gallery 62 is supplied in dynamic components such as crankshaft 12, intake camshaft 16 and exhaust camshaft 18, and supplement apparatus such as water pump 40 and so on.

This engine 2, as shown in FIGS. 4 and 5, has a variable valve timing apparatus 64 formed as an oil pressure control unit. In the variable valve timing apparatus 64, an oil pressure actuator 66 is arranged for varying the phase of crankshaft 12. This oil pressure actuator 66 has an oil control valve 68 to supply oil delivered from the oil pump 56. The oil pressure actuator 66 is mounted adjacent one end of intake camshaft 16. The oil control valve 68 is installed to a front part 36 of chain cover 14.

Figure 6:
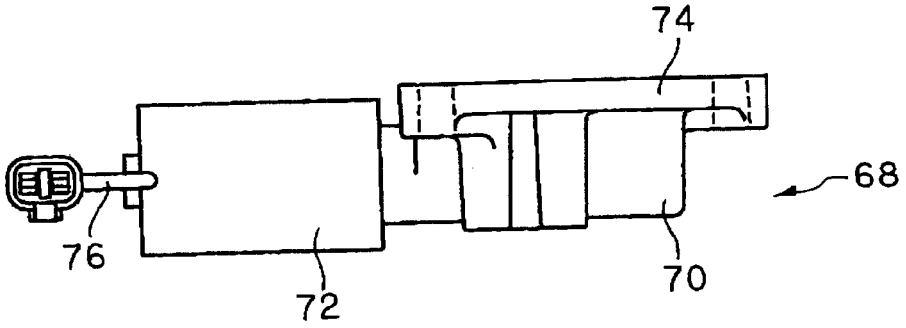
FIG. 6 is a plane view of an oil control valve.
Figure 7:
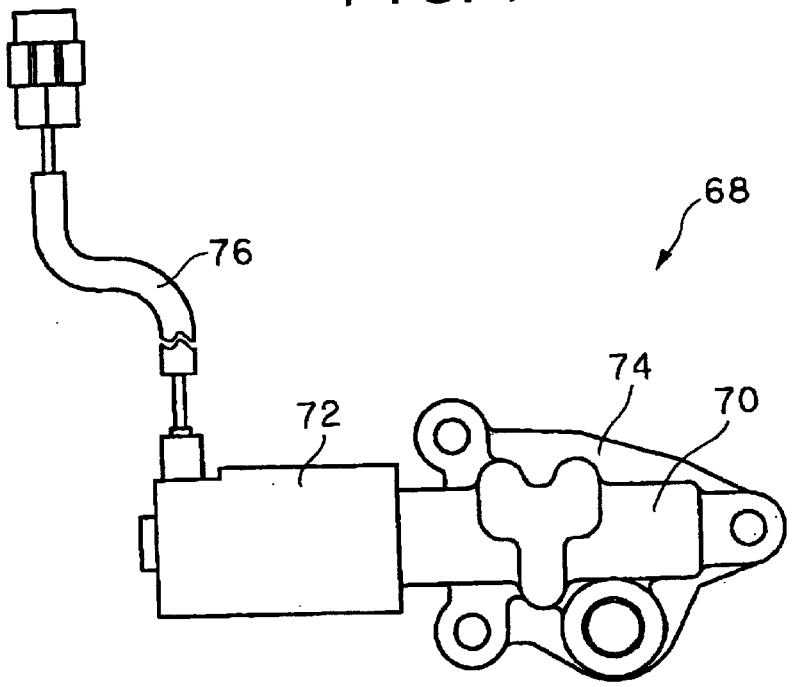
FIG. 7 is a front view of the oil control valve.
Figure 8:
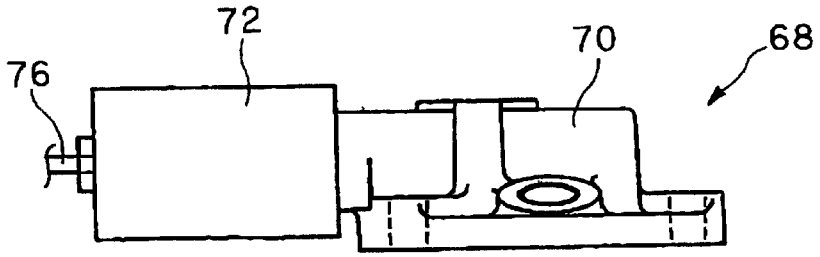
FIG. 8 is a base view of the oil control valve.

The oil control valve 68, as shown in FIGS. 6 to 8, includes a column-shaped main valve part 70 for supplying oil to the oil pressure actuator 66 and a column-shaped solenoid part 72 for working the main valve part 70. The main valve part 70 and the solenoid part 72 are connected as one body in the longitudinal direction thereof. The main valve part 70 mounts therein a spool valve (not shown) and has an installation flange part 74. The solenoid part 72 mounts therein a solenoid coil (not shown), and links to an actuator cable 76.

The oil control valve 68 is positioned by mounting (FIGS. 4 and 5) the installation flange part 74 to a valve installation boss part 78 which is located on front part 36 of chain cover 14 by an installing bolt 80. The valve installation boss part 78 is located on front part 36 of chain cover 14. The oil control valve 68 is installed to almost a central part of chain cover 14 so as to extend across abutting side faces "P" of cylinder head 6 and cylinder block 4. Furthermore, the oil control valve 68 from its one end as mounted to valve installation boss part 78 extends diagonally and downward to its other end positioned adjacent water pump pulley 46.

In front part 36 of chain cover 14, a mount installation boss part 82 and an outlet pipe installation boss part 84 are arranged on the upper part of valve installation boss part 78. On the mount installation boss part 82, an engine mount (not shown) for supporting the engine 2 on the vehicle body is installed. On the outlet pipe installation boss part 84, a water outlet pipe 86 for returning coolant from cylinder block 4 to a radiator (not shown) is installed.

The main gallery 62 which receives oil from oil pump 56 connects at one end to a cover connecting hole 88 of chain cover 14. An oil pipe 90 connects to hole 88 and supplies oil to the oil control valve 68. The oil control valve 68 divides the oil and supplies it to an advance angle oil path 92 and a retard angle oil path 94 as arranged in chain cover 14.

The advance angle oil path 92 and the retard angle oil path 94 are respectively connected to an advance angle oil pipe 96 and a retard angle oil pipe 98 at an upper end of the chain cover 14. The advance angle oil pipe 96 and the retard angle oil pipe 98 respectively connect to a cap advance angle oil path 100 and a cap retard angle oil path 102 as provided in intake camshaft cap 20. The cap advance angle oil path 100 and the cap retard angle oil path 102 connect to the oil pressure actuator 66 through a camshaft oil path (not shown) and a camshaft retard angle oil path (not shown), respectively, arranged in intake camshaft 16.

The variable valve timing apparatus 64, by control means (not illustrated), controls the oil control valve 68 according to a driving state of engine 2, and supplies oil to the oil pressure actuator 66, distributing the oil delivered from oil pump 56 to advance angle oil and retard angle oil. Furthermore, the variable valve timing apparatus 64 can vary valve timing of intake valve and exhaust valve by varying the phase of the intake camshaft 16 relative to the crank axle 12.

The installation of oil control valve 68 in the variable valve timing apparatus 64, as shown in FIG. 1, is established by arranging the valve installation boss part 78 so that oil control valve 68 is mounted within the rotation trace "S" of cooling fan 54 provided at front part 36 of chain cover 14. The oil control valve 68 can be installed in rotation trace "S" of cooling fan 54 by being mounted on the valve installation boss part 78 as provided on the front part 36 of chain cover 14. The trace "S" represents the cylindrical space defined by the outer diameter of the fan 54 and extending rearward thereof toward the chain cover 14.

The oil control valve 68 has the main valve part 70 for supplying oil to the oil pressure actuator 66 and the solenoid part 72 for actuating the main valve part 70, arranged so that the longitudinal direction "A" of this solenoid part 72 points toward the axis of rotation C of cooling fan 54.

The oil pipe 90 which supplies oil delivered from oil pump 56 is connected to the oil control valve 68. This oil pipe 90 has its intermediate part formed into a bend 104 which projects toward the axis of rotation C of cooling fan 54. The bend or curve part 104 can be located at least in part in rotational trace "S" of cooling fan 54. The oil pipe 90 is located in the front of the front part 36 of chain cover 14.

The operation of the invention will now be briefly described.

The engine 2 transmits rotation of crankshaft 12 to intake camshaft 16 and exhaust camshaft 18 by timing chain 32, to effect opening and closing of intake and exhaust valves. In addition, engine 2 transmits rotation of crankshaft 12 to supplement apparatuses such as water pump 40 and alternator 42 by drive belt 52.

In the engine 2, the variable valve timing apparatus 64 is arranged as an oil pressure control unit and controls the oil control valve 68 according to the driving state of the engine 2, and supplies oil to the oil pressure actuator 66. Furthermore, the variable valve timing apparatus 64 can vary the valve timing of the intake and exhaust valves.

The oil control valve 68 of the variable valve timing apparatus 64 is mounted to front part 36 of chain cover 14 so as to be located in the rotational trace "S" of cooling fan 54 so that the air discharged from the fan flows over the oil control valve to effect cooling thereof.

More specifically, the installation positioning of oil control valve 68 allows positively cooling of solenoid part 72, which generates heat when oil control valve has been electrically turned on, and this can reduce changes in the valve characteristics at different operating conditions such as when going from the cool state until the engine is in an operating state.

Accordingly, because the installation structure of the oil control valve 68 can reduce a change of valve characteristic at intervals from the cool state until the engine is started into an operating state, the control of oil control valve 68 becomes easy, and the controlling of oil pressure actuator 66 is improved, and the controlling accuracy of the variable valve timing apparatus 64 is improved.

In addition, because the installation of the oil control valve 68 is arranged on front part 36 of chain cover 14 pointing in the longitudinal direction "A" of solenoid part 72 toward axis of rotation C of cooling fan 54, the cooling wind occurs in a direction from axis of rotation C toward the outside, and the solenoid part 72 is arranged in position along the flow of the cooling wind. As a result, cooling property of solenoid part 72 is improved, and a change of valve characteristics is decreased.

Furthermore, in the installation of the oil control valve 68, because oil pipe 90 is located on front part 36 of chain cover 14 so as to be located in the rotational trace "S" of the cooling fan 54, the oil which flows through the oil pipe 90 is cooled by the cooling wind. As a result, the oil is prevented from reaching a high temperature, and stability of control can be achieved.

Figure 9:
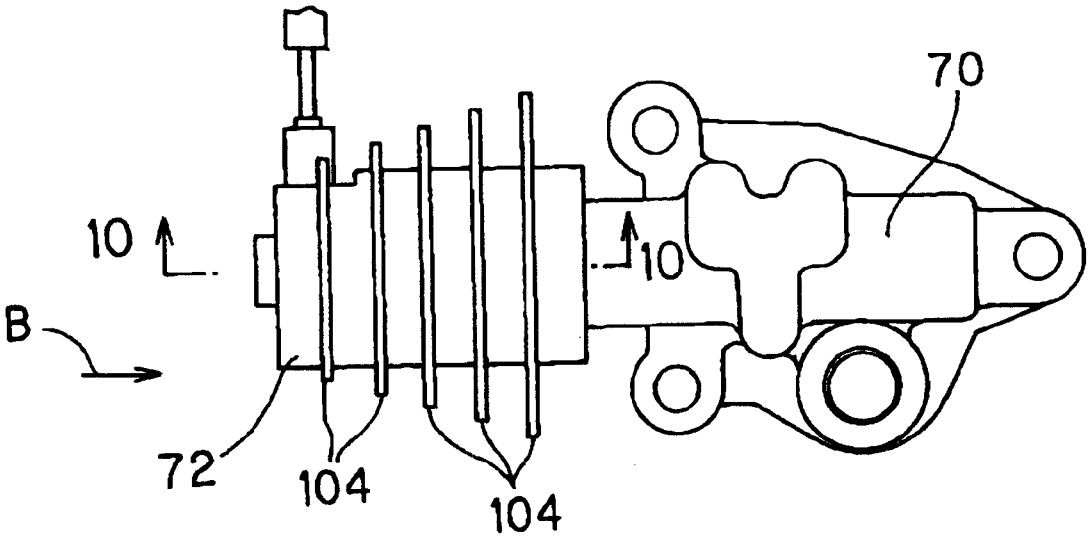
FIG. 9 is a front view of an oil control valve showing a second embodiment in this invention.
Figure 10:
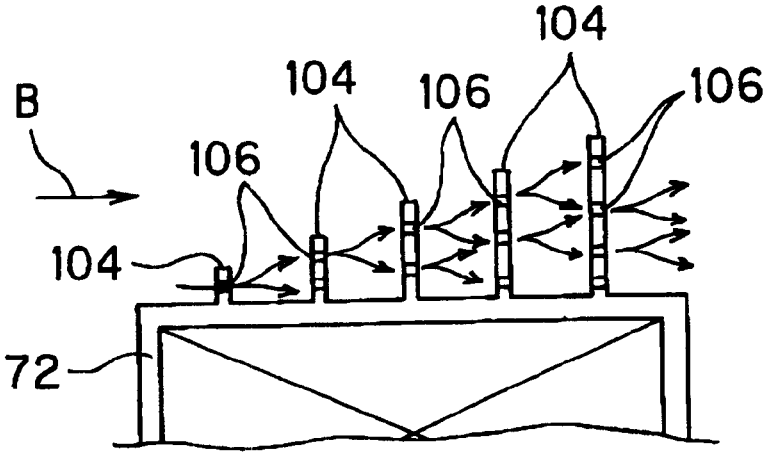
FIG. 10 is an enlarged cross-sectional view taken on line 10—10 in FIG. 9.

FIGS. 9 and 10 show a second embodiment. In an installation structure of an oil control valve 68 in this second embodiment, plural cooling fins of diameters which gradually increase as the plural cooling fins are spaced further from axis of rotation C of cooling fan 54 are formed on solenoid part 72 of oil control valve 68 in flow direction "B" of cooling wind from cooling fan 54. And in each cooling fin several holes 106 are formed for passing cooling wind blows therethrough.

In the installation structure of the oil control valve 68 in this second embodiment, the diameter of the cooling fins gradually increase as the plural fins are spaced further from axis of rotation C of cooling fan 54, and are formed on solenoid part 72 so as to resist flow of cooling wind in flow direction "B". The solenoid part 72 can thus be cooled efficiently because the cooling wind from cooling fan 54 touches the plural sequentially positioned cooling fins 104.

Furthermore, in the second embodiment, because plural passing holes 106 have been formed in the cooling fins, the cooling wind can blow through the passing holes in between the plural cooling fins 104, and the solenoid part 72 can be cooled more efficiently by contacting cooling wind with plural cooling fins 104. As a result, this installation structure of the oil control valve 68 can reduce any change of valve characteristic at intervals from the cool state until the engine is started into an operating state.

Accordingly, the control of oil control valve 68 becomes easy, and the controlling of oil pressure actuator 66 is improved, and the controlling accuracy of variable valve timing apparatus 64 is improved.

In the installation structure of an oil control valve of this invention, because oil controlling parts are installed on a front surface of a chain cover so as to be located in the rotational trace of a cooling fan rotated by a crankshaft, the oil control valve can be cooled by cool wind from the cooling fan, thus reducing any change of valve characteristic at intervals from the cool state until the engine is started into an operating state.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. An installation structure of an oil control valve, wherein a timing chain transmits rotation of a crank axle of an engine to camshafts, a chain cover is installed on the engine to cover the timing chain, a cooling fan rotated by the crank axle is located forward of a front part of the chain cover, an oil pump is driven by the crank axle, and an oil control valve which supplies oil delivered from the oil pump to an oil pressure actuator for an oil pressure control unit is located on the front part of the chain cover in a rotational air flow trace of the cooling fan, wherein the oil control valve has a main valve part for supplying oil to said oil pressure actuator and a solenoid part for actuating the main valve part, and further wherein the oil control valve is arranged on the front part of the chain cover so that a longitudinal direction of the solenoid part points toward a rotational center of the cooling fan.

2. An installation structure as defined in claim 1, wherein an oil pipe supplying oil delivered from the oil pump is connected to the oil control valve, and the oil pipe is located on the front part of chain cover so as to be located in the rotational air flow trace of the cooling fan.

3. An installation structure according to claim 1, wherein the oil control valve has a plurality of cooling fins which project outwardly therefrom.

4. A vehicle engine arrangement comprising an engine having a rotatable crankshaft and a rotatable camshaft, a timing chain mechanism disposed adjacent one end of the engine for transmitting rotation of the crankshaft to the camshaft, a chain cover secured to an end of the engine so as to enclose the timing mechanism, the chain cover having a front part, a cooling fan rotated by the crankshaft and located forwardly of the front part of the chain cover so that the cooling fan defines a generally cylindrical air flow trace which extends rearwardly from the periphery of the cooling fan toward the front part of the chain cover, an oil pump associated with the engine and driven by the crankshaft, and an oil control valve controlling the supply of oil from the oil pump to an oil pressure actuator mounted on the engine, said oil control valve being mounted on the front part of the chain cover between the chain cover and the cooling fan so as to be positioned generally within the cylindrical air flow trace defined by the cooling fan, wherein the oil control valve includes an electric solenoid actuator part connected in series with a spool valve part, said spool valve and solenoid parts being longitudinally elongated and disposed in joined longitudinally aligned relationship, and the oil control valve being oriented on the front part of the chain cover so that the longitudinal direction of the oil control valve is oriented generally toward a rotational axis of the cooling fan.

5. An engine arrangement according to claim 4, wherein an oil supply pipe is connected between the oil control valve and the oil pump and has at least a portion thereof located in front of the chain cover within the cylindrical air flow trace of the cooling fan.

6. An engine arangement according to claim 4, wherein the solenoid part has cooling fins which project outwardly therefrom into the flow of air moving therepast.

* * * * *